US007134223B2

(12) United States Patent
Ganon

(10) Patent No.: US 7,134,223 B2
(45) Date of Patent: Nov. 14, 2006

(54) ELASTOMERIC SOLE FOR USE WITH CONVERTED FLATBED SEWING MACHINE

(75) Inventor: Michael H. Ganon, Blacklick, OH (US)

(73) Assignee: Sewing Innovations and Machine Co., Columbus, OH (US)

( * ) Notice: Subject to any disclaimer, the term of this patent is extended or adjusted under 35 U.S.C. 154(b) by 132 days.

(21) Appl. No.: 10/744,969

(22) Filed: Dec. 22, 2003

(65) Prior Publication Data

US 2004/0159013 A1 Aug. 19, 2004

Related U.S. Application Data

(63) Continuation-in-part of application No. 10/200,856, filed on Jul. 23, 2002, now Pat. No. 6,666,157.

(51) Int. Cl.
*A43B 13/28* (2006.01)

(52) U.S. Cl. ..... 36/12; 36/16; 36/22 R; 36/28

(58) Field of Classification Search ..... 36/25 R, 36/32 R, 12, 16, 21, 22 R, 28
See application file for complete search history.

(56) References Cited

U.S. PATENT DOCUMENTS

| | | | | |
|---|---|---|---|---|
| 532,429 | A | 1/1895 | Rogers | |
| 1,167,885 | A * | 1/1916 | Carll | 36/32 R |
| 4,250,638 | A * | 2/1981 | Linnemann | 36/11 |
| 4,308,671 | A * | 1/1982 | Bretschneider | 36/11 |
| 4,345,387 | A | 8/1982 | Daswick | |
| 4,364,186 | A * | 12/1982 | Fukuoka | 36/3 B |
| 4,449,307 | A * | 5/1984 | Stubblefield | 36/32 R |
| 4,541,185 | A | 9/1985 | Chou | |
| D298,583 | S | 11/1988 | Yung-Mao | |
| 4,896,441 | A | 1/1990 | Galasso | |
| 5,197,207 | A | 3/1993 | Shorten | |
| 5,367,791 | A | 11/1994 | Gross et al. | |
| 5,381,607 | A * | 1/1995 | Sussmann | 36/28 |
| 5,493,791 | A * | 2/1996 | Kramer | 36/28 |
| 5,619,809 | A | 4/1997 | Sessa | |
| 5,839,208 | A * | 11/1998 | Huang | 36/28 |
| 5,853,844 | A * | 12/1998 | Wen | 428/119 |
| 5,946,824 | A * | 9/1999 | Tighe et al. | 36/28 |
| 5,983,529 | A | 11/1999 | Serna | |
| 6,061,928 | A * | 5/2000 | Nichols | 36/28 |
| 6,131,310 | A * | 10/2000 | Fang | 36/28 |
| 6,138,383 | A | 10/2000 | Steinke et al. | |
| 6,178,662 | B1 | 1/2001 | Legatzke | |
| 6,367,172 | B1 | 4/2002 | Hernandez | |
| 6,425,194 | B1 | 7/2002 | Brie | |

(Continued)

FOREIGN PATENT DOCUMENTS

DE 3904974 * 9/1989

*Primary Examiner*—Marie Patterson
(74) *Attorney, Agent, or Firm*—Mueller Smith & Matto

(57) ABSTRACT

The present invention addresses an elastomeric sole having a sidewall with a height less that 0.625 inch, forming a cavity and a horizontally disposed rim extending from the top surface of the sidewall. The sole includes at least two upstanding regions extending upwardly from the cavity lower surface, each region formed from elastomer and having a different effective modulus of elasticity. The invention also includes the combination of an elastomeric sole and an upper and a method for sewing an elastomeric sole to an upper by means of a converted sewing machine.

14 Claims, 6 Drawing Sheets

U.S. PATENT DOCUMENTS 6,560,900 B1 5/2003 Bray, Jr. et al.

6,754,982 B1 * 6/2004 Reed et al. ..... 36/30 A

* cited by examiner

ELASTOMERIC SOLE FOR USE WITH CONVERTED FLATBED SEWING MACHINE

CROSS-REFERENCE TO RELATED APPLICATIONS

The present application is a Continuation-in-Part of application Ser. No. 10/200,856 filed Jul. 23, 2002 by Michael H. Ganon, now U.S. Pat. No. 6,666,157.

STATEMENT REGARDING FEDERALLY SPONSORED RESEARCH

Not applicable.

BACKGROUND OF THE INVENTION

Footwear manufacturers and designers continually strive to find ways to make footwear more comfortable and durable. To this end, inserts and footpads commonly are used in the art to provide shock absorbency, advantageous weight distribution, cushioning, ventilation, and other benefits.

Many of these designs are inserts, which may be used in a previously purchased shoe or boot. For example, U.S. Pat. No. 532,429 describes an elastic heel and sole for boots. The heel and sole consist of cushions, pads, or air cells that are secured to a flexible in-sole, which then is inserted into a boot.

U.S. Pat. No. 4,345,387 describes an inner sole for use with a shoe having an upper and a sole structure. The inner sole rests upon the upper surface of the sole structure and has a plurality of upwardly extending protrusions, which bend, depress or telescope to conform to the shape of the wearers foot. When depressed, some air from inside the protrusions will flow between the inner sole and the sole structure; however, most of the air will remain trapped to provide a spring action when the foot is lifted off the ground.

U.S. Pat. No. 4,896,441 describes a removable innersole for footwear. The innersole has the shape of the sole of the shoe and has a plurality of discrete, elements extending toward the sole of the shoe. These elements distribute the weight of the wearer along a surface greater than the sole of the shoe alone.

U.S. Pat. No. 5,197,207 describes a sport or rehabilitation shoe having an insert part formed from elastic compressible material. The insert is positioned in a recess of the shoe sole or midsole in the area of the ball of the foot. This provides the shoe with increased stability for wearers whose feet tend to tilt inwardly.

U.S. Pat. No. 5,367,791 describes a shoe sole insert that includes downwardly extending foam-filled compressible regions. The insert is housed between a midsole and an insole board.

U.S. Pat. No. 5,983,529 describes a shock absorbing cassette to be inserted between the outer sole and midsole of a shoe, preferably to be used by skateboarders. The cassette includes a base and sets of deformable cushion elements.

U.S. Pat. No. 6,138,383 describes an insert for a conventional walking or running shoe. The insert includes cavities formed in the insert bottom face that provide a spring action at a point of impact or applied force.

U.S. Pat. No. 6,178,662 describes a footpad for use in a sole, insole, or heel. The footpad includes a plurality of resilient lugs. The side surfaces of the lugs define therebetween a void which extends lattice-like over the footpad. The lugs transmit downward pressure to the pad from which they extend. The volume between adjacent lugs decreases as downward pressure is applied. Fluid, such as a gas, a liquid, or a viscous or a plastic material, also may be incorporated in the lugs.

U.S. Pat. No. 6,367,172 describes a shoe for active wear including an outsole, padding, an insole and an upper. A cavity is formed in the outer sole with the padding adhesively bonded therein.

U.S. Pat. No. 6,425,194 B1 describes a cushioning insole specifically designed based on the foot of the wearer. Using a pressure map of the wearer's foot, the cushioning insole is created. The insole has a central layer whose upper surface conforms to the wearer's foot. The bottom surface of the central layer has a layout of spaced apart pressure receiving fingers. Each finger has a predetermined height and diameter such that the fingers as a whole optimally suit the pressure map of the foot.

U.S. Des. 298,583 shows a midsole having an upper surface that cradles the foot of the wearer and a bottom surface having a plurality of downwardly extending protrusions.

While providing potential benefits to the wearer, the above-described inserts are designed to be placed in conventional footwear. None of these patents disclose footwear having a specially designed sole that, rather than being an insert or an addition, is the actual sole of the footwear.

U.S. Pat. No. 5,619,809 does describe a sole assembly for providing air circulation around the foot. This sole assembly, however, is a somewhat complicated assembly including five separate components. These components include an outsole, an insert, a conventional insole, and an orthotic. The insert is suspended above the outsole to provide an air chamber. A plurality of pins extending downwardly from the insert correspond to opening pockets in the outsole. When depressed (i.e., when subjected to a load), the pins deform and fill the pockets. When the pockets are filled, further deformation of the pins is restricted by the walls of the pockets enabling the sole assembly to resist high impact forces.

U.S. Pat. No. 6,560,900 B2 describes a sole having a honeycomb pattern and a vamp connected thereto. The sole includes a vertical extending sidewall to which the vamp is sewn. The height of the sidewall must be sufficient to provide a lip for stitching to the vamp's lower perimeter.

Sewing of an upper to a sole as described with respect to the '900 patent can be difficult and time-consuming. An improvement for sewing a sole to an upper is disclosed in U.S. Ser. No. 10/200,856, by Michael H. Ganon now U.S. Pat. No. 6,666,157, the disclosure of which is hereby incorporated by reference. In that patent, method and apparatus are disclosed wherein a basic flatbed sewing machine design is converted for sewing through a thick workpiece such as a molded rubber or elastomeric sole having a sewing rim extending generally horizontally from either its top or bottom surface. To connect such a sole with an upper by a stitching procedure, the design facilitates the operational tasks of the sewing machine operator, permitting the holding of the two pieces to be joined with both hands and permitting the thus joined and aligned assemblage to be held down against a work surface as well as an upstanding guide surface. This arrangement achieves both accurate and desirably positioned stitching and results in less operator fatigue and substantial minimization of any opportunity for "kick-out" of the workpieces being joined together.

With the approach of the invention, preexisting basic sewing machines can be retrofitted very simply, for example, using a screwdriver, at relatively low cost inasmuch as the drive mechanisms of the basic machine, for example, incorporating cam actuation and the like are not altered. Correspondingly, the stroke of the machine is not altered. Thus, sewing machines with which operators are already familiar may be retrofitted for the production of footwear such as slippers or the like with relatively thick molded rubber soles and cloth uppers for a given production interval, for example, three months. Following that interval, the machines readily are converted back to their original structuring for production of a next product. As a consequence of the resultant low cost tooling for these specific products, cost of the products themselves are substantially reduced to the extent that superior products are cost competitive with preexisting inferior ones.

The method and apparatus disclosed in the '157 patent enables rubber or elastomeric soles to be easily sewn to an upper. Eastomeric soles for use with the converted sewing machine of the '157 patent continue to be sought.

BRIEF SUMMARY OF THE INVENTION

The present invention is addressed to an elastomeric sole, the combination of an elastomic sole and an upper, and a method for sewing an elastomeric sole to an upper by a converted sewing machine. The elastomeric sole is configured to be used in a retrofitted or converted sewing machine and includes a sidewall having a height less than about 0.625 inch. A horizontally disposed rim extends outwardly from the top surface of the sidewall. The sidewall defines a cavity within which are two upstanding regions extending upwardly from the cavity's lower surface, each region being formed from an elastomer and having a different effective modulus of elasticity.

The invention also includes the combination of an elastomeric sole, as described above, and an upper. The upper includes a continuous connector ledge extending about its lower surface, the continuous connector ledge being sewn to the elastomeric sole rim.

Finally the invention addressed a method for sewing an upper to an elastomeric sole using a converted sewing machine. The method includes the steps of providing an elastomeric sole and an upper, such as those described above. The next step of the invention calls for providing a sewing machine comprising a flatbed defining a first work surface, an arm extending outwardly over the flatbed to a compound sewing mechanism including a compound reciprocating needle and top feed mechanism and a height adjustable presser foot. A bobbin and sewing hook are mounted for actuation below the first work surface for operational association of bobbin fed thread with needle carrying thread to define a sewing station. The cover plate assembly is provided having a lower plate portion at the first work surface with a feed dog workpiece advancing component receiving slot, an edge guide having a guide surface generally extending upwardly normally to the lower plate portion a distance corresponding with the first workpiece thickness portion to an elevated second work surface operable with the top feed mechanism and presser foot and which is generally parallel with the first work surface and includes a needle receiving slot. A feed dog assembly including the workpiece advancing component is provided, the latter component being extensible through the receiving slot of the cover plate assembly and a thread sequestering channel component is provide adjacent to the workpiece advancing component which extends upwardly to a needle receiving opening located for reciprocatory movement adjacent the needle receiving slot at the second working surface. A sewing drive mechanism is provided for carrying out the actuation of the needle, top feed mechanism, bobbin, sewing hook and feed dog assembly. The final step of the method calls for sewing the upper to the elastomeric sole using the sewing machine.

Other aspects of the invention will, in part, be obvious and will, in part, appear hereinafter. The invention, accordingly, comprises the method and apparatus possessing the construction, combination of elements, arrangement of parts and steps which are exemplified in the following detailed description.

For a fuller understanding of the nature and objects of the invention, reference should be made to the following detailed description taken in connection with the accompanying drawings.

DETAILED DESCRIPTION OF THE INVENTION

The sewing machine retrofit feature functions, in effect, to elevate the sewing or working surface of a conventional, flatbed, basic sewing machine without incurring excessive costs. In this regard, there is no alteration of the stroke of the machine as would involve camming changes and the like. With the elimination of such complexity, the basic sewing machine can be returned, for example after three months working with molded soles, to other products not requiring the elevated surface, again at minimal cost and, in general, through the simple utilization of a screwdriver. In concert with this working or sewing surface elevation the retrofit achieves solution to a resultant operational defect otherwise evoking thread breakage and solves the workpiece retention difficulties otherwise encountered with molded rubber soles.

Figure 1:
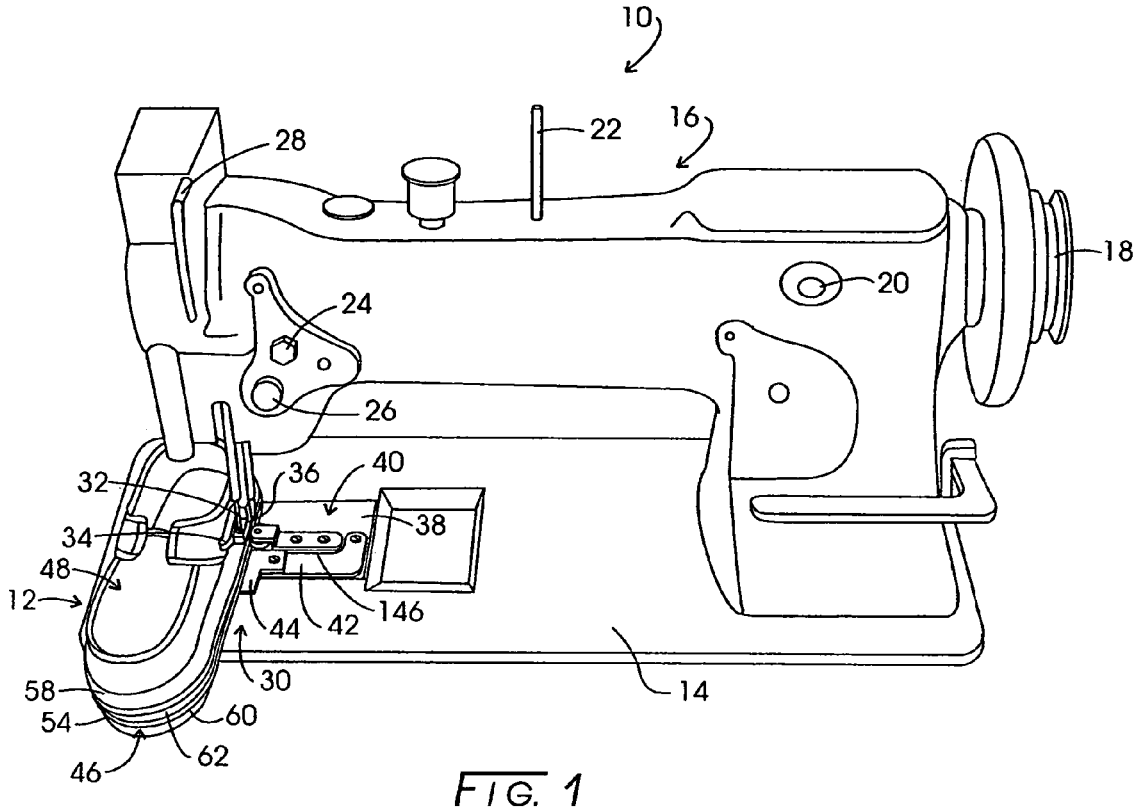
FIG. 1 is a perspective view of a converted flatbed basic sewing machine illustrating its operation in sewing a cloth slipper upper to a molded rubber sole.

FIG. 1 reveals the salient features of the ubiquitous flatbed industrial sewing machine as it is converted or modified. The sewing machine is depicted in general 10 as it is in the process of producing a slipper 12. Illustrated machine 10 is, for example, a model LU-562 produced by Tokyo Juki Industrial Co., Ltd. of Tokyo, Japan. The machine 10 is seen to have a flatbed 14 over which is supported an arm represented generally at 16. Rearwardly, the machine 10 incorporates a hand wheel 18 and a feed graduation plate 20. Forwardly on the arm 16 is a thread guide bar 22, thread pressure nut 24, spring guide disc 26, and a take-up lever 28. The sewing station for the compound form of sewing activity of machine 10 is represented by the arrow 30 and, in the instant figure, reveals a needle 32, presser foot 34 and L-shaped upper feed 36 through which the needle 32 is extensible. A bobbin cover plate is shown at 38 upon which are mounted a rim edge guide shown generally at 40 and a retractable rim alignment guide 41 which is pivotally mounted to plate 38 at 42 and includes a generally L-shaped rim engagement and aligning plate 44. Alignment guide 41 may be retracted from involvement at the sewing station 30 by rotation about the pivot 42. The guide 41 is employed in particular with rim and molded sole structures wherein the rim extends from the bottom surface of the sole and therefore is flexed for alignment with a sewing platform prior to sewing.

Figure 2:
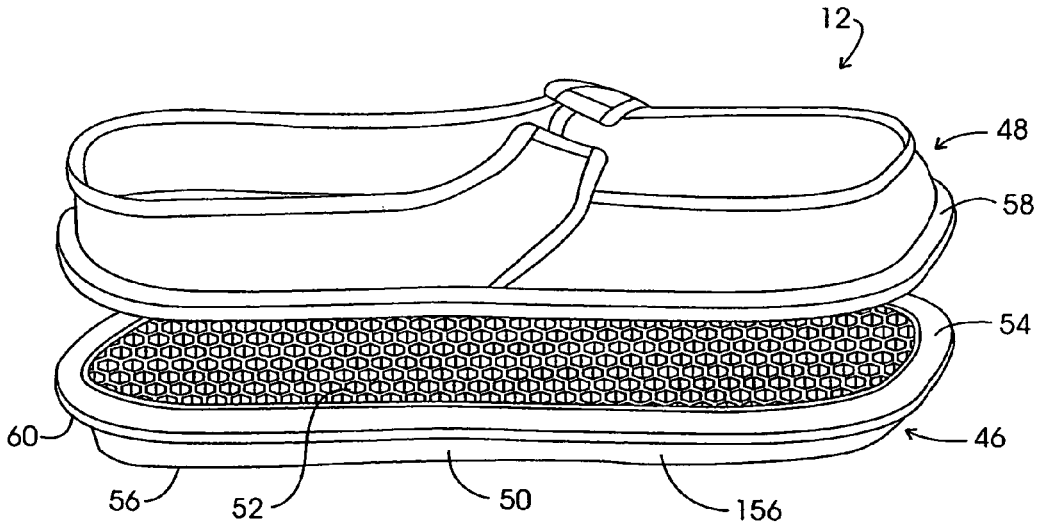
FIG. 2 is an exploded perspective view of the slipper shown in FIG. 1 illustrating a molded rubber sole and a cloth upper.

Looking additionally to FIG. 2, the slipper 12 is illustrated in perspective and exploded fashion. The slipper model 12 is seen to be formed with a molded rubber sole represented generally at 46 to which is sewn a prefabricated cloth upper represented generally at 48. Molded sole 46 is formed with two rubber components of differing durometer. In this regard, sole 46 incorporates a somewhat outwardly disposed higher durometer outer portion 50 within which there is formed a softer, lower durometer honeycomb format formed interior part 52. Note, that for the present embodiment, the molded sole 46 at its upward surface is configured with an integrally formed outwardly extending rim 54. Typically, the bottom or ground engaging surface of the sole 46 as shown at 56 will extend varying distances below the corresponding bottom surface 58 of rim 54. The molded sole typically will be thicker, for example, about ⅝" in the heel and arch region and will taper to about ¼" in thickness toward the toe region. Cloth upper 12 is seen having a continuous connector ledge 58 extending about its lower surface. It is the function of the retrofitted sewing machine 10 to sew the ledge 58 to the rim 54 while holding the upper 48 in alignment with the sole 46. This procedure is generally represented in FIG. 1 wherein a slight gap 60 is shown between the unsewn upper 48 and sole 46 as the slipper 12 is being maneuvered through sewing station 30. Note that the sole 46 bottom surface 56 is in adjacency with the working surface level of the bed 14 while the conjoined rim 54 and ledge 58 are elevated above that surface.

Figure 3:
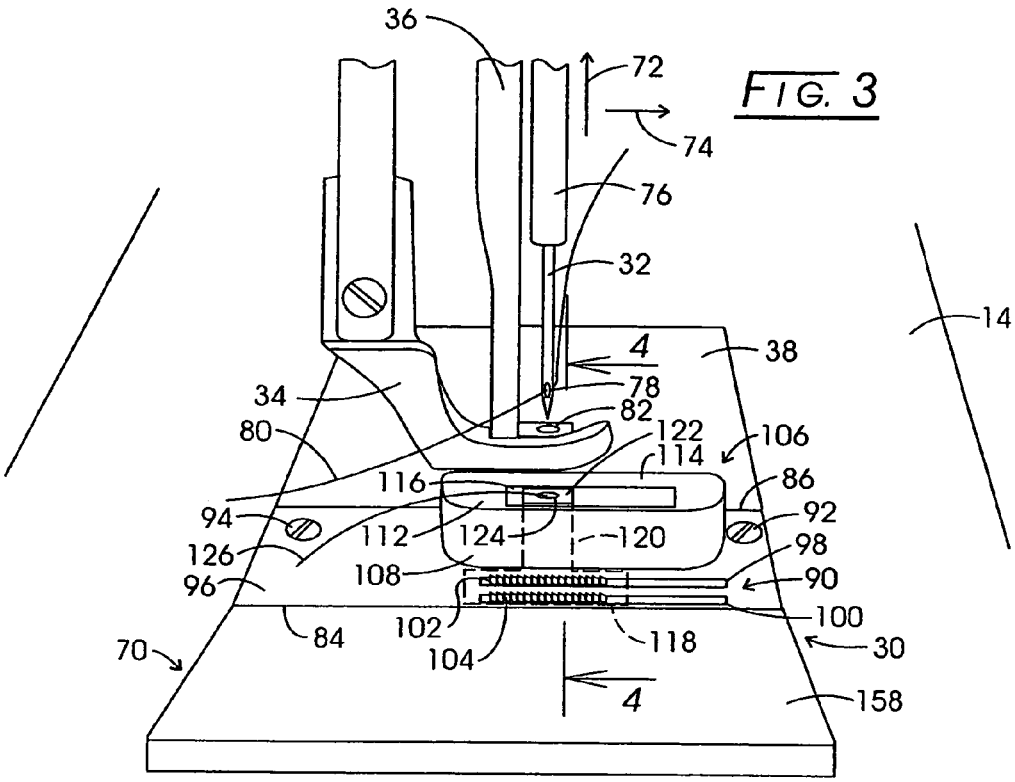
FIG. 3 is a partial perspective view of the sewing station and a slanted auxiliary work surface associated therewith, the components of the sewing station being represented in a mode wherein the needle is moving upwardly and in a recovery orientation horizontally.

Looking to FIG. 3, flatbed 14 is illustrated in conjunction with the sewing station 30; rearwardly extending plate cover 38; and a forwardly extending and inwardly sloping auxiliary working surface component represented generally at 70. The figure reveals the orientation of needle 32 and upper feed 36 as the needle 32 is moving upwardly, as represented at arrow 72, and toward the operator as represented at arrow 74. Needle 32 is shown removably connected to needle drive member 76. For the retrofit at hand, the needle 32, while a typical one, is selected having a foreshortened shank portion to provide a shaft length increase of about ⅛". Note additionally, that the center of the needle eye 78 through which spool supplied thread 80 passes is closer to the tip or point than needles employed for the conventional use of the sewing machine 10. This achieves a maximum utilization of the available stroke of the mechanism of the device. Such needles may be type 135×16 or 175×3. The tip of the needle 32 is shown poised above the aperture 82 within the horizontal leg of upper feed 36. Note, additionally, that using conventional machine adjustment procedures, the presser foot 34 has been elevated as earlier illustrated in connection with FIG. 1. Mounted in the manner of a conventional cover plate between the inward edge 84 of working surface 70 and the forward or outward edge 86 of cover plate 38 is an elevated sewing surface cover plate assembly represented generally at 90. Attached to the bed 14 with two machine screws 92 and 94 the assembly 90 is formed having a lower plate portion 96, the upward surface of which is substantially coplanar with the upper surface of cover plate 38 and bed 14. Within that lower plate portion are two elongate dog receiving slots 98 and 100 through which protrude the multi-tooth or serrated gripper or workpiece advancing components 102 and 104 of a customized feed dog. Not shown are the blocking teeth components formed within cover plate 90 and which perform in concert with workpiece advancing components 102 and 104.

Cover plate 90 further is configured supporting a generally tower or platform-like structure shown generally at 106. Structure 106 is configured having an outwardly disposed edge guide 108 with a surface 110 extending upwardly and generally normally to the lower plate portion 96. Edge guide 108 forms a portion of the support of an elevated sewing platform 112 the upper surface of which at 114 is disposed generally in parallel with the upper surface of lower plate portion 96. An elongate, rectangular needle receiving slot 116 is shown formed within the platform 112.

The feed dog assembly for the instant application is customized for utilization with the elevated sewing surface and is shown partially in phantom at 118 as not only supporting the workpiece advancing components 102 and 104, but also supporting and reciprocally actuating a tube-like thread sequestering chamber component shown partially in phantom at 120 which is seen to extend into adjacency with slot 116 at upper surface 122. A cylindrical opening extends as a channel fully through the tube-like thread sequestering component 120, the upward aperture or opening thereof being seen in the figure at 124. Note that bobbin supplied thread 126 is shown emerging from the upward opening 124.

Figure 7:
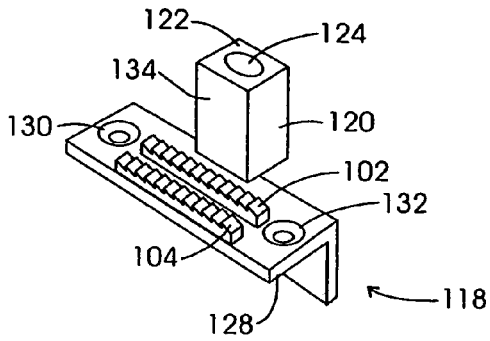
FIG. 7 is a perspective view of a conversion feed dog.

Looking momentarily to FIG. 7, the one piece feed dog assembly 118 is revealed in perspective fashion. Assembly 118 includes an angle-form base 128 functioning to support the grippers 102 and 104 as well as the overlapping support of thread sequestering component 120. This provides clearance for the internal channel, the upward opening of which is seen at 124. Feed dog 118 is attached to the cam actuated drive mechanism of the sewing machine 10 through conventionally spaced machine screws, the openings therefore being revealed at 130 and 132.

The channel or passageway within thread sequestering component 120 for use in fabricating shoe products as described in conjunction with FIG. 2 will have a width-wise extent of about 3/32 inch and a principal diametric extent of about 1/8 inch. Structure 120 itself can be employed with a square cross-sectional dimension of about 5/16 inch and the forward or outward edge of the opening 124 will be spaced from the forward surface 134 about 13/64 inch. In general, the upstanding height or lengthwise extent of component 120 will be about 7/16 inch, again for the application represented in FIG. 2. That dimension in general will correspond with the distance from the bottom surface 56 of molded sole 46 to the underside surface 58 of rim 54 as that distance is of maximum value for the sole, for example, in the heel-arch region.

Figure 4:
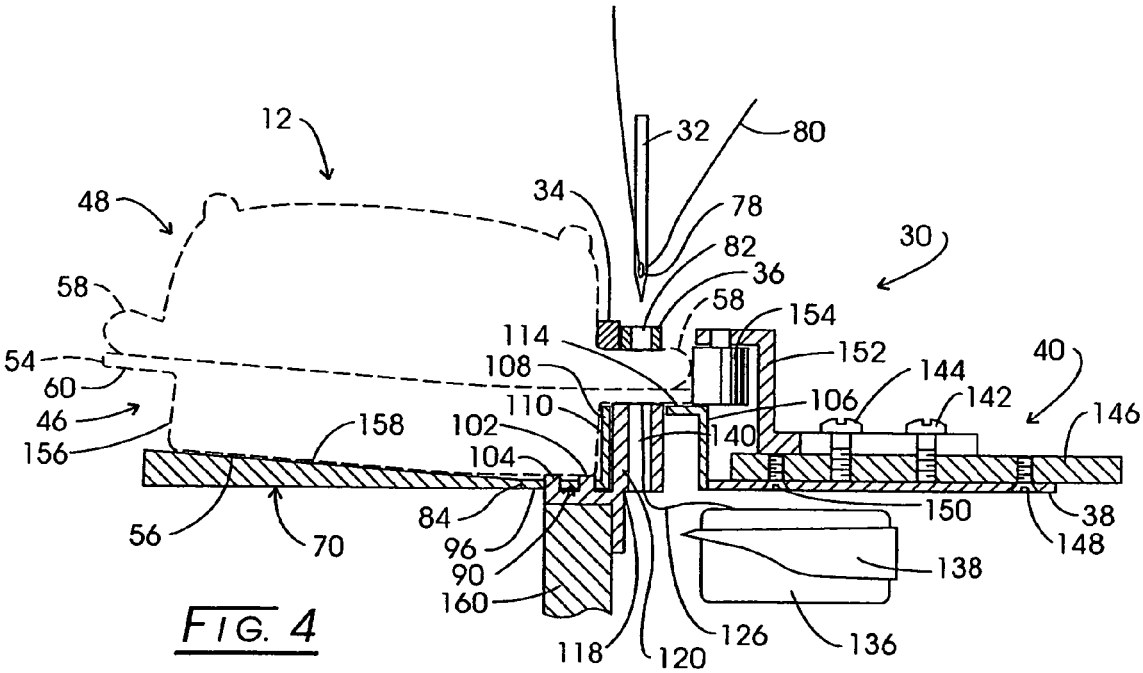
FIG. 4 is a sectional view taken through the plane 4—4 shown in FIG. 3.

Turning to FIG. 4, a sectional portrayal of the feed dog assembly 180, cover plate assembly 90 and auxiliary working surface component 70 is provided in conjunction with a cross-sectional representation of the molded sole 46 and upper 48 of slipper 12. In the figure, a bobbin assembly 136 is revealed at 136 in an orientation wherein bobbin rotation is about a vertical axis. Associated operationally with the bobbin 136 is a sewing hook 138 and the bobbin thread again is shown at 126 extending through the interior channel 140 of thread sequestering component 120. Rim edge guide 40 is connected to cover plate 38 by machine screws 142 and 144 and is seen having a upwardly depending angular portion 146 extending over and supporting a guide roll 148. Guide roll 148 is seen to be positioned adjacent the upper surface 114 of tower-like structure 106. As the operator, using two hands, maneuvers the two-component workpiece through sewing station 30, presser foot 34 and upper feed 36, when engaged, will tend to distort or flatten out the continuous connector ledge 58 of upper 48. The operators' two hands in pushing down on the two-component work piece will urge that portion of the molded sole 46 at 150 extending between bottom 56 and the ridge bottom 58 into engagement against surface 110 of edge guide 108. This task is aided, as is apparent, by the inwardly sloping surface 152 of auxiliary working surface component 70. As this is occurring, the lower surface 58 of rim 54 is positioned over the upper or elevated sewing surface 114. Note that the guide role 148 is in contact with the outer periphery of ledge 58 and functions to orient ledge 58 with respect to the needle 32 in a consistent inward spacing manner. Typical spacing will provide a final product wherein stitching is about 1/4 inch inward from the edge of ledge 58. FIG. 4 also reveals the cam actuated mechanical drive 154 to which the feed dog 118 is attached by machine screws extending through openings 130 and 132 (FIG. 7).

Figure 5:
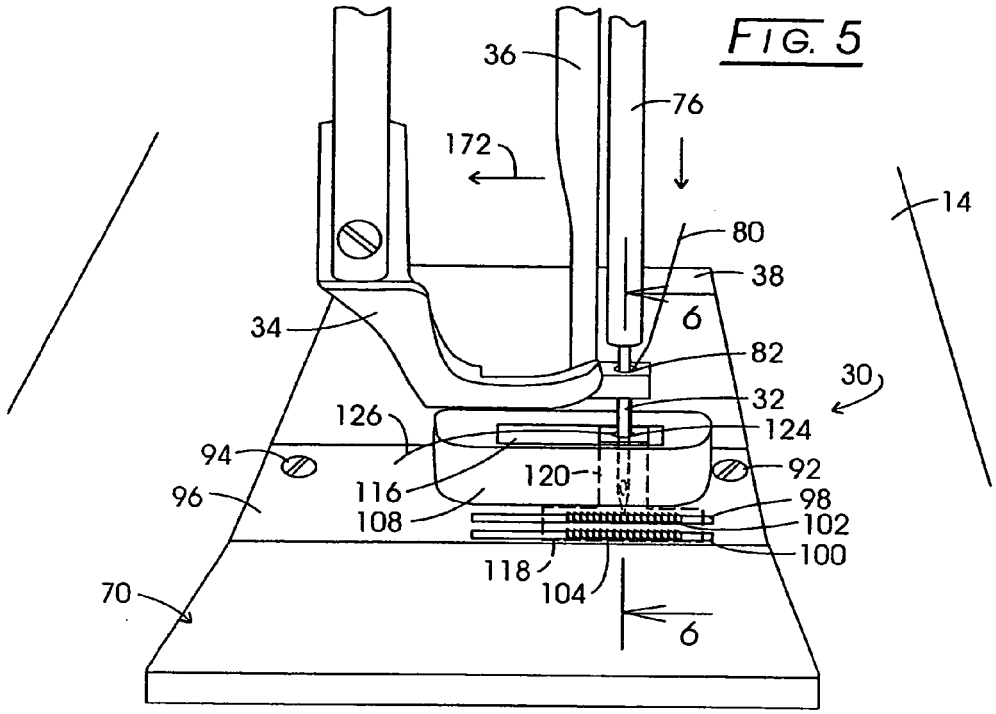
FIG. 5 is a partial perspective view in the manner of FIG. 3 showing an orientation wherein the needle is moving downwardly in a stitch-forming motion.

Referring to FIG. 5, another stage in the compound sewing maneuvers at sewing station 30 is revealed. In the figure, the needle 32 is being driven downwardly as represented at arrow 170 while the needle, upper feed 36 and feed dog 118 are also being driven horizontally in a material advancing direction as represented at arrow 172. Note that the tip of needle 32 is within the thread sequestering component 120 channel and the orientation of workpiece advancing components 102 and 104, as well as connected chamber component 120 are located in a region of commencement of a stitch.

Figure 6:
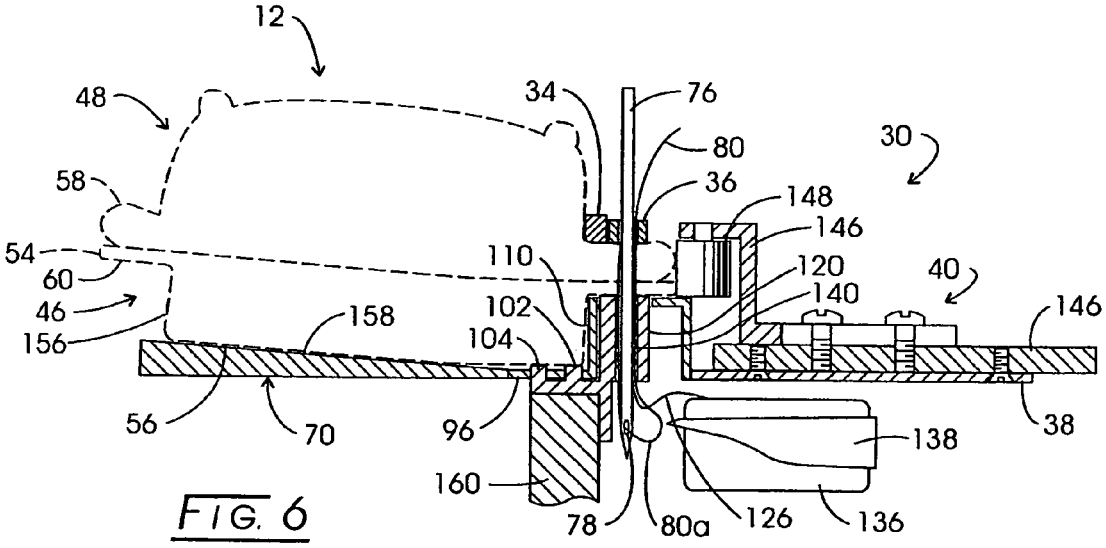
FIG. 6 is a sectional view taken through the plane 6—6 shown in FIG. 5 and illustrating two phantom workpieces being joined.

FIG. 6 reveals a sectional detail of this orientation of FIG. 5 in conjunction with a phantom cross-sectional representation of the sole 46 and upper 48. At this juncture in the procedure, the friction enhancing bottom 56 of molded sole 46 is engaging upper surface 158 of auxiliary working surface component 70. Additionally, it may be recalled that the operator, using both hands, is pushing down and inwardly on the assemblage of molded sole 46 and upper 48 such that the sole lower outer surface 156 beneath the ridge lower surface 60 is in contact with surface 110 of edge guide 108. The frictional engagement of the sole bottom 56 with surface 158 is overcome, however, to provide movement in the noted direction represented by arrow 172 by virtue of the material advancement components 102 and 104, as well as the corresponding movement of forward feed 36 as thinner portions and a lesser height of the side surface 156 are encountered, the sole bottom 56 in the vicinity of advancing components 102 and 104 tends to lift off of them but with a concomitant reduction in overall surface contact with surface 158. Thus, operator fatigue continues to be avoided. It may be observed that with the emergence of the tip of needle 76 below the thread sequestering component 120 a loop in thread 80 will be formed as represented at 80*a*. Loop 80*a* is of correct size for engagement by sewing hook 138 because of the presence of component 120. Without the presence of that component, the loop would be much too large and engaged not once but twice by the sewing hook 138 to break thread.

FIGS. 8A through 8E schematically portray a lock-stitch forming sequence carried out with the conversion or adaptation of a standard flat bed machine as described in the discourse above. For clarity of presentation, the bobbin 136 and sewing hook 138 are shown as rotating about a horizontal as opposed to a vertical axis. Depicted in the drawing is the particularly selected needle 32, the feed forward component 36, thread sequestering component 120, thread 180 and one of the workpiece advancing components as at 104. The stitch is shown being formed within the abutting rim 54 and ledge 58.

Figure 8A:
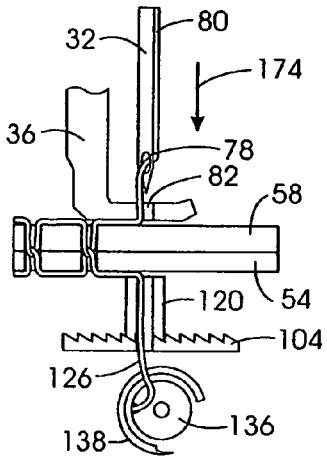
FIGS. 8A–8E schematically illustrate a sequence of operations of a modified sewing station.

In FIG. 8A needle 32 is represented as descending toward the workpiece as represented at arrow 174. Bobbin thread 126 extends through the channel of component 120 to the next previous stitch as does the needle carrying thread 80.

Figure 8B:
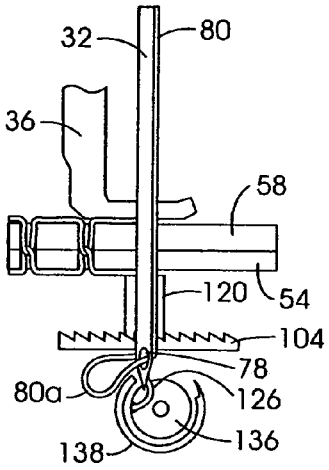
Figure 8C:
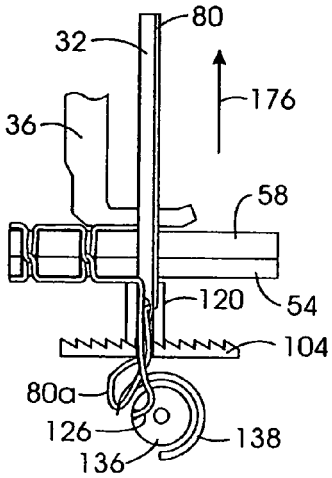

FIG. 8B shows an orientation of needle 32 wherein the tip and the eyelet 78 have descended through the channel of the sequestration component 120 into the vicinity of sewing hook 138. Note that a loop has been formed in thread 80 as represented at 80*a* and that sewing hook 138 has rotated in a counterclockwise fashion and is about to encounter and pass through the loop 80*a*. In developing the retrofit or conversion arrangement, it was found that the component 120 is quite necessary to avoid forming too large a sewing loop. In effect, the sewing hook 138 would pass through such a large loop twice and break the thread. The loop 80*a* being of proper size, as shown in FIG. 8C and arrow 176, needle 32 has commenced to move upwardly with some tension on the thread 80. At the same time, the leading edge of sewing hook 138 has engaged or passed through loop 80*a*.

Figure 8D:
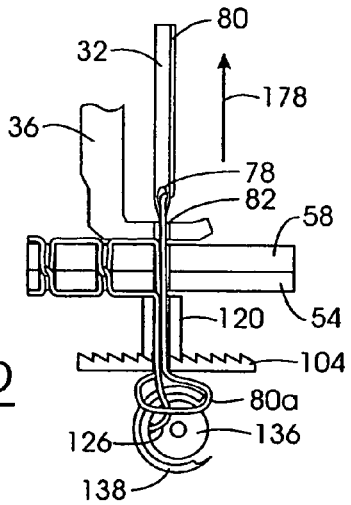

Looking to FIG. 8D, it may be observed, as represented at arrow 178, that the tip of needle 32 has emerged from the opening 82 in forward feed 36 and sewing hook 138 is releasing from the thread loop 80*a* and has caused the bobbin thread 126 to pass through loop 80*a*.

Figure 8E:
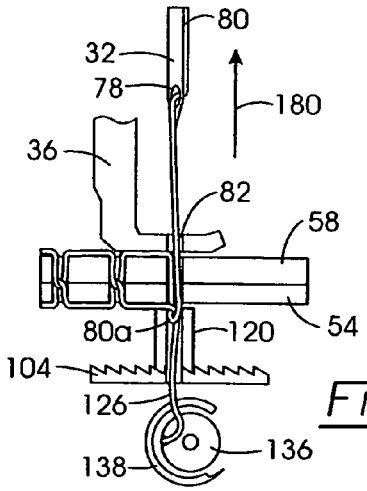

Looking to FIG. 8E, as represented at arrow 180, needle 32 has moved more fully upwardly and the needle thread 80 is being pulled tight by a lever on the sewing machine 10 to form the stitch.

Another aspect of the invention is an elastomeric sole which can easily and quickly be sewn to an upper using the converted sewing machine and method described above in connection with FIGS. 1–8A–E. This elastomeric sole is shown and described in detail in FIGS. 9–13.

Figure 9:
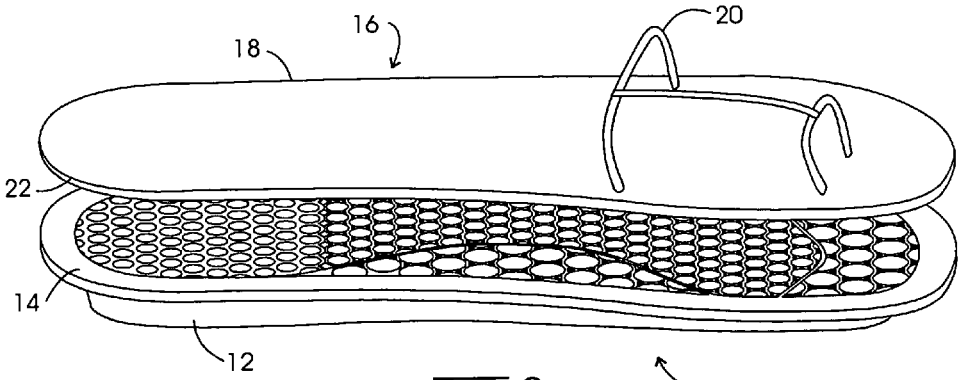
FIG. 9 is a perspective view of an upper spaced apart from and above an elastomeric sole.

Looking to FIG. 9, the inventive elastomeric sole is shown generally at 10. Elastomeric sole 10 is formed by molding the interior of the sole with lower durometer and, thus, softer material which is 3-dimentionally contoured to support the foot with a shaped heel cradle, arch support and toe grip. Outside portions of the molded sole, then, are formed with a stiffer, higher durometer value material to establish desired strength or robustness. Elastomeric sole 10 includes a sidewall, 12, and a horizontally disposed rim, 14. An upper, spaced apart from and above elastomeric sole 10, is shown generally at 16. Upper 16 is configured as a sandal having an inner sole, 18, and a thong portion, 20. Upper 16 also includes a continuous connector ledge, 22, which corresponds to horizontally disposed rim 14. Using the converted sewing machine described above, upper 16 is placed on elastomeric sole 10 and continuous connector ledge 22 is sewn to horizontally disposed rim 14. Combination of the upper and elastomeric sole in this manner eliminates the need for adhesive attachment, which causes the resulting footwear to be rigid and inflexible. Such adhesive attachment also may wear out over time causing the upper and the sole to become partially or fully detached from one another. Although shown in FIG. 9 as a sandal, upper 16 is not limited to this configuration. Upper 16 may be any conventional upper, including but not limited to sandals, thongs, shoes, boots, etc.

Figure 12:
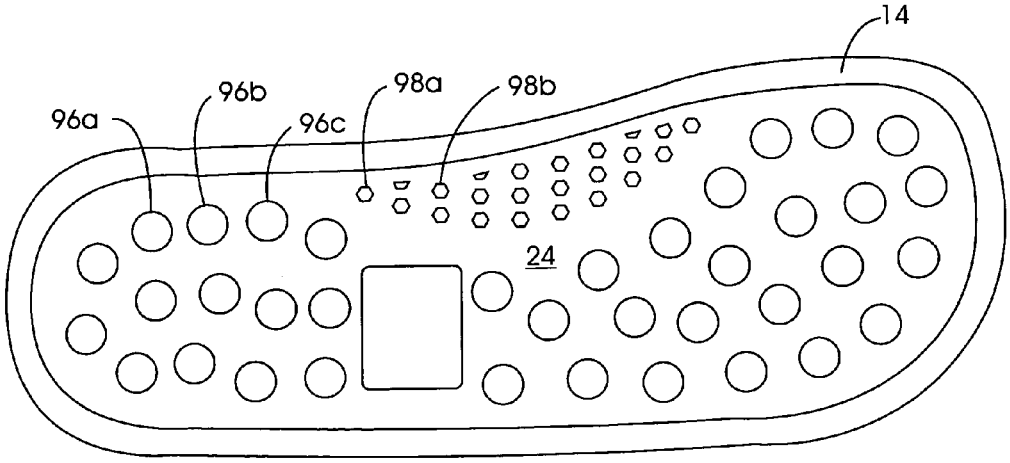
FIG. 12 is a bottom view of the elastomeric sole shown in FIG. 9.

FIGS. 10–13 reveal the construction advantages of the elastomeric sole. Looking first to FIG. 11, elastomeric sole 10 is seen to include an integrally formed outer portion composed of sidewall 12, which has a top surface, 32, and a bottom surface, 34, with a height extending therebetween. As described above, this outer portion generally is formed with a stiffer, higher durometer value material to establish desired strength or robustness. For example, the outer portion may be formed from thermoplastic rubber (TPR) having a durometer of between 65 to 75. Extending outwardly from sidewall top surface 32 is horizontally disposed rim 14. Sidewall 12 defines a cavity (not shown), which will be described in greater detail below. Elastomeric sole 10 also has a bottom surface, 24 (FIG. 12). Elastomeric sole 10 extends from a heel portion, shown generally at 28, to a toe portion, shown generally at 30. In order to be used with the converted sewing machine described above, the height of sidewall 12, extending between top surface 32 and bottom surface 34, should be no greater than about ⅝ of an inch, i.e., 0.625 inch. It may be seen that the height of sidewall 12 tapers between heel portion and toe portion, as shown generally at 36. Thus, the resultant molded sole typically will exhibit a maximum height or thickness, 38, of about ⅝ inch at heel portion 28, such height or thickness diminishing or tapering non-uniformly toward toe portion 30 to a thickness, 40, of about ⅜ inch or less. These heights are measured excluding the thickness of rim 14. Rim 14 preferably has a thickness of about ⅛ of an inch or 0.125 inch and a width of about 0.343 inch. Rim 14 is seen to be horizontally disposed with respect to sidewall 12. "Horizontally disposed" in this context means that the rim generally will be horizontal, but may be at a slight angle either above or below horizontal with respect to sidewall 12.

Figure 10:
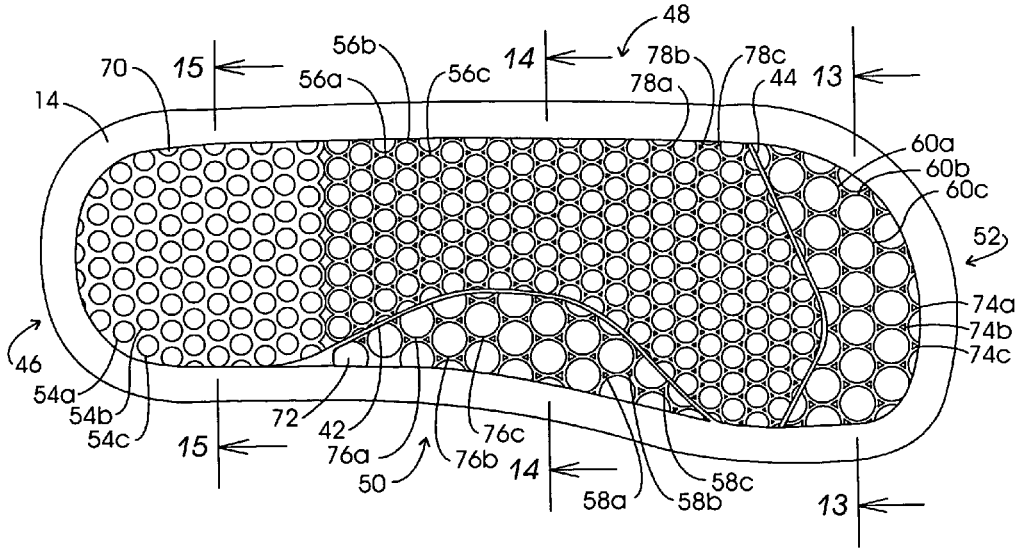
FIG. 10 is a top view of the elastomeric sole shown in FIG. 9.
Figure 11:
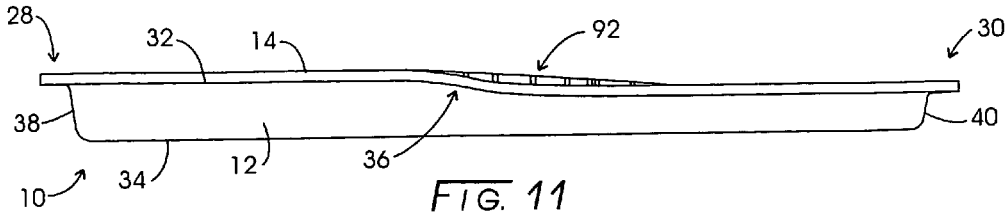
FIG. 11 is a side view of the elastomeric sole shown in FIG. 9.

Turning now to FIG. 10, the inner portion of elastomeric sole 10 is revealed. This inner portion lies within the cavity defined by sidewall 12 and is 3-dimentionally contoured to support the foot with a shaped heel cradle (not shown), arch support, the edge of which is shown at 42, and a toe grip, 44. The inner portion may be formed from thermoplastic rubber (TPR) having a durometer that is softer than the outer portion, having, for example, a durometer between about 35 to about 40. Because the weight of the wearer is not evenly distributed across the entire surface of the sole, the inner portion of elastomeric sole 10 is designed with at least two upstanding regions that extend upwardly from the surface of the cavity, each region being formed from an elastomer and having a different effective modulus of elasticity. As used herein, "effective modulus of elasticity" is intended to mean the ratio of the applied stress to the change in shape of the elastic body. The elastomer's composition and structure (configuration) together determine the effective modulus of elasticity for a given region. For example, two regions may be formed from the same elastomer, but one region may include a filler, such as a gas (i.e., air), particulates (i.e., fiberous material, uniform or random size particles), etc. Alternatively, two regions may be formed using two different elastomers. Such elastomers include but are not limited to SBR rubber, vinyl rubbers, thermoplastics, thermoset plastics, acrylics, urethanes, neoprenes, etc.

Figure 13:
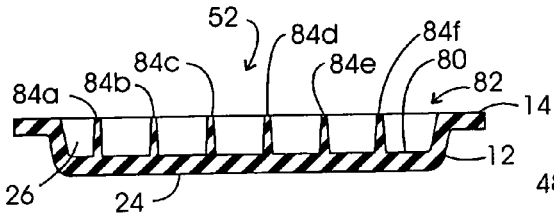
FIG. 13 is a cross-sectional view taken through the plane 13—13 in FIG. 10 showing the tubular members of the elastomeric sole's toe region.
Figure 14:
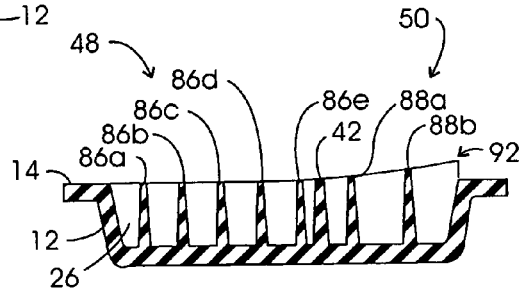
FIG. 14 is a cross-sectional view taken through the plane 14—14 in FIG. 10 showing the tubular members of the elastomeric sole's central and arch regions.
Figure 15:
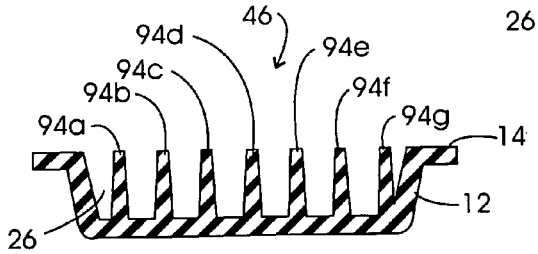
FIG. 15 is a cross-sectional view taken through the plane 15—15 in FIG. 10 showing the tubular members of the elastomeric sole's heel region.

FIG. 10 illustrates yet another way to vary the effective modulus of elasticity in the various regions. Elastomeric sole 10 includes four regions, including a heel region 46, a central region, 48, an arch region 50, and a toe region 52. In this example, all of the regions are formed from the same elastomer. It is the elastomer's structure that determines each region's effective modulus of elasticity. Each region includes a plurality of tubular members formed from upstanding tubular walls, which extend upwardly from cavity lower surface 80 (FIGS. 13–15). As can be seen, the tubular members within a given region are uniform with respect to diameter and wall thickness. These variables change, however, from region to region, the diameter and wall thickness of the tubular members determining the effective modulus of elasticity of a given region. Heel region 46 includes tubular members, such as those represented at 54*a*, 54*b*, and 54*c*. Central region 48 includes tubular members, such as those represented at 56*a*, 56*b*, and 56*c*. Arch region 50 includes tubular members, such as those represented at 58*a*, 58*b*, and 58*c*. Toe region 52 includes tubular members, such as those represented at 60*a*, 60*b*, and 60*c*. Toe region 52's tubular members have the largest diameters and thinnest wall thicknesses giving that region the smallest effective modulus of elasticity. Having tubular members that are smaller in diameter with correspondingly larger wall thicknesses than those of toe region 52 gives arch region 50 a greater effective modulus of elasticity. This region, however, has a smaller effective modulus of elastic than either central region 48 or heel region 46. In similar fashion, central region 48 has an effective modulus of elasticity greater than arch region 50 but smaller than 46 heel region. Heel region 46 has the greatest effective modulus of elasticity; its tubular members having the smallest diameters and the thickest walls.

While it is preferred that the tubular members have a cylindrical cross-section, other shapes may be used. A closed configuration, or full cylinder, also is preferred but partial tubular members may be used. Such partial tubular members are shown about the edges of the cavity, for example, as at 70 and 72. Areas between adjacent tubular members may be filled, i.e., with the same elastomer or a different elastomer, or may be hollow spaces, as at 74*a*–74*c*, 76*a*–76*c*, and 78*a*–78*c*. Unfilled, the hollow spaces provide ventilation between adjacent tubular members.

FIG. 13 is a cross-sectional view of toe region 52 taken through the plane 13—13 in FIG. 10. It may be seen that sidewall 12 of elastomeric sole 10 may be disposed at an angle, shown generally at 82 between the cavity lower surface, 80, and rim 14. The tubular members' wall thicknesses for this region are shown representatively at 84*a*, 84*b*, 84*c*, 84*d*, 84*e*, and 84*f*. Preferably, each tubular member of toe region 52 has a diameter of about 0.375 inch and a wall thickness of about 0.032 inch.

FIG. 14 is a cross-sectional view taken through the plane 14—14 in FIG. 10. This view shows the cross-section of representative tubular members of central region 48. In particular, tubular member wall thickness of this region can be seen at 86*a*, 86*b*, 86*c*, 86*d*, and 86*e*. Preferably, each tubular member of central region 48 has a diameter of about 0.25 inch and a wall thickness of about 0.025 inch. Similarly, FIG. 14 also illustrates the cross-section of representative tubular members of arch region 50. Wall thicknesses of those tubular members are shown at 88*a* and 88*b*. Preferably, each tubular member of arch region 50 has a diameter of about 0.375 inch and a wall thickness of about 0.032 inch. Running between central region 48 and arch region 50 is toe grip 42. The upperwardly extending tubular members may extend slightly higher than the height of sidewall 12 and rim 14 as illustrated generally at 92. It should be noted, though, that the tubular members should not have a height greater than 0.625 inch.

FIG. 15 is a cross-sectional view taken through the plane 15—15 in FIG. 10. The wall thicknesses of heel region 46's tubular members are illustrated at 94*a* through 94*g*, inclusive. Preferably, each tubular member of heel region 46 has a diameter of about 0.25 inch and a wall thickness of about 0.070 inch. An additional way to adjust the effective modulus of elasticity of a region is to taper the tubular members as shown in FIGS. 13–15.

Elastomeric soles having the construction described above advantageously may be manufactured using a two shot molding process. In the first step or shot of the process, the relatively higher durometer elastomer forms the horizontally disposed rim, the sidewall, and portions of the cavity interior surface. In the second molding step or second shot, the remaining portions of the cavity interior surface and tubular members are molded with lower durometer, and thus softer, elastomeric material.

Finally, FIG. 12 shows a bottom view of elastomeric sole 10. The bottom surface, 24, bears a pattern of protrusions or treads. These protrusions are illustrated, for example, at 96*a*, 96*b*, and 96*c*, as well as 98*a* and 98*b*. These treads may protrude outwardly about 1/16 inch (0.0625), for example, from bottom surface 24. Bottom surface 24 also may bear graphics or alphanumeric characters.

Since certain changes may be made in the above-described apparatus and method without departing from the scope of the invention herein involved, it is intended that all matter contain in the description thereof or shown in the accompanying drawings shall be interpreted as illustrative and not in a limiting sense.

I claim:

1. An elastomeric sole, comprising:

(a) a sidewall having a top surface, a bottom surface, and a height extending therebetween, said height being less than about 0.625 inch;

(b) a cavity lower surface which with said sidewall forms a cavity;

(c) a horizontally disposed rim extending outwardly from said sidewall; and (d) at least two upstanding regions extending upwardly from said cavity lower surface, each region formed from elastomer and having a different effective modulus of elasticity, and each said upstanding region including a plurality of tubular members formed from upstanding tubular walls, each tubular member extending vertically upwardly from said cavity lower surface, said tubular member walls having a thickness corresponding to a said effective modulus of elasticity.

2. The elastomeric sole of claim 1, wherein each of said tubular member walls has a circular cross-section.

3. The elastomeric sole of claim 1, wherein said tubular member walls taper outwardly from said cavity lower surface.

4. The elastomeric sole of claim 3, having four upstanding regions including a heel region, a central region, an arch region, and a toe region, wherein said heel region exhibits a greater modulus of elasticity than said central region which exhibits a greater modulus of elasticity than said arch region which exhibits a greater modulus of elasticity than said toe region.

5. The elastomeric sole of claim 4, wherein:

each said tubular member of said heel region has a diameter of about 0.25 inch;

each said tubular member of said central region has a diameter of about 0.25 inch;

each said tubular member of said arch region has a diameter of about 0.375 inch; and each said tubular member of said toe region has a diameter of about 0.375 inch.

6. The elastomeric sole of claim 4, wherein:

each said heel region tubular member wall thickness is about 0.070 inch;

each said central tubular member wall thickness is about 0.025 inch;

each said arch region tubular member wall thickness is about 0.032 inch; and each said toe region tubular member wall thickness is about 0.032 inch.

7. The elastomeric sole of claim 6, wherein:

each said tubular member of said heel region has a diameter of about 0.25 inch;

each said tubular member of said central region has a diameter of about 0.25 inch;

each said tubular member of said arch region has a diameter of about 0.375 inch; and each said tubular member of said toe region has a diameter of about 0.375 inch.

8. A combination of an elastomeric sole and an upper, comprising:

an elastomeric sole comprising:

(a) a sidewall having a top surface, a bottom surface, and a height extending therebetween, said height being less than about 0.625 inch;

(b) a cavity lower surface which with said sidewall forms a cavity;

(c) a horizontally disposed rim extending outwardly from said sidewall; and (d) at least two upstanding regions extending upwardly from said cavity lower surface, each region formed from elastomer and having a different effective modulus of elasticity, each said region including a plurality of tubular members each extending vertically upwardly from said cavity lower surface and having a thickness corresponding to a said effective modulus of elasticity; and an upper comprising:

(d) a continuous connector ledge extending about its lower surface, said continuous connector ledge being sewn to said elastomeric sole rim.

9. The combination of claim 8 wherein each of said tubular members has a circular cross-section.

10. The combination of claim 8, wherein said tubular members of said two or more regions taper upwardly outwardly from said cavity lower surface.

11. The combination of claim 10, having four upstanding regions including a heel region, a central region, an arch region, and a toe region, wherein said heel region exhibits a greater modulus of elasticity than said central region which exhibits a greater modulus of elasticity than said arch region which exhibits a greater modulus of elasticity than said toe region.

12. The combination of claim 11, wherein:

each said tubular member of said heel region has a diameter of about 0.25 inch;

each said tubular member of said central region has a diameter of about 0.25 inch;

each said tubular member of said arch region has a diameter of about 0.375 inch; and each said tubular member of said toe region has a diameter of about 0.375 inch.

13. The combination of claim 11, wherein:

each said heel region tubular member wall thickness is about 0.070 inch;

each said central tubular member wall thickness is about 0.025 inch;

each said arch region tubular member wall thickness is about 0.032 inch; and each said toe region tubular member wall thickness is about 0.032 inch.

14. The elastomeric sole of claim 13, wherein:

each said tubular member of said heel region has a diameter of about 0.25 inch;

each said tubular member of said central region has a diameter of about 0.25 inch;

each said tubular member of said arch region has a diameter of about 0.375 inch; and each said tubular member of said toe region has a diameter of about 0.375 inch.

* * * * *